US010309659B2

(12) United States Patent
Moon et al.

(10) Patent No.: US 10,309,659 B2
(45) Date of Patent: Jun. 4, 2019

(54) GAS OVEN

(71) Applicant: SAMSUNG ELECTRONICS CO., LTD., Suwon-si, Gyeonggi-do (KR)

(72) Inventors: Seong Cheol Moon, Gwacheon-si (KR); Sung Kwang Kim, Hwaseong-si (KR); Yun Ic Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 235 days.

(21) Appl. No.: 15/407,924

(22) Filed: Jan. 17, 2017

(65) Prior Publication Data

US 2017/0138611 A1 May 18, 2017

Related U.S. Application Data

(63) Continuation of application No. 14/136,008, filed on Dec. 20, 2013, now Pat. No. 9,568,200.

(30) Foreign Application Priority Data

Dec. 21, 2012 (KR) ..... 10-2012-0150580

(51) Int. Cl.
*F24C 3/08* (2006.01)
*F24C 15/32* (2006.01)
(Continued)

(52) U.S. Cl.
CPC ..... *F24C 15/322* (2013.01); *F23D 14/62* (2013.01); *F24C 3/087* (2013.01); *F24C 15/001* (2013.01); *F23D 2203/007* (2013.01)

(58) Field of Classification Search
CPC ..... F24C 15/322; F24C 3/087; F24C 15/001; F23D 14/62; F23D 2203/007
See application file for complete search history.

(56) References Cited

U.S. PATENT DOCUMENTS 3,384,068 A 5/1968 Perry et al.
3,507,265 A * 4/1970 Dills ..... F24C 14/025 126/21 R
(Continued)

FOREIGN PATENT DOCUMENTS

CN 1474088 A 2/2004
CN 1548810 A 11/2004
(Continued)

OTHER PUBLICATIONS

Chinese Office Action dated Apr. 6, 2017 in corresponding Chinese Patent Application No. 201310714536.5.
(Continued)

*Primary Examiner* — Alfred Basichas
(74) *Attorney, Agent, or Firm* — Staas & Halsey LLP

(57) ABSTRACT

A gas oven configured to use a single cooking cavity being divided into a plurality of individual cooking cavities by mounting a divider at the cooking space. The gas oven includes a forced air supplying device capable of forcedly supplying air to the individual cooking space at an upper portion of the cooking space, and a natural air discharging device capable of naturally discharging waste air of the individual cooking space at a lower portion of the cooking space, when each individual cooking space is shut off by the divider.

13 Claims, 9 Drawing Sheets

(51) Int. Cl.

| | |
|---|---|
| ***F24C 15/00*** | (2006.01) |
| ***F23D 14/62*** | (2006.01) |

(56) References Cited

U.S. PATENT DOCUMENTS

| | | | |
|---|---|---|---|
| 3,624,742 | A | 11/1971 | Hurko |
| 3,682,156 | A | 8/1972 | Perl |

FOREIGN PATENT DOCUMENTS

| | | | | |
|---|---|---|---|---|
| CN | 1653300 | A | | 8/2005 |
| CN | 1731025 | A | | 2/2006 |
| CN | 201640276 | U | | 11/2010 |
| DE | 10 2007 039 379 | | | 2/2009 |
| EP | 1 624 255 | | | 2/2006 |
| EP | 1657493 | | * | 6/2006 |
| GB | 2 321 962 | | | 8/1998 |
| KR | 10-2004-0063594 | | | 7/2004 |
| KR | 10-2011-0092489 | | | 8/2011 |

OTHER PUBLICATIONS

European Intention to Grant dated Jan. 16, 2018, in corresponding European Patent Application No. 13 198 895.8, 41 pgs.
Chinese Office Action dated Jan. 24, 2018, in corresponding Chinese Patent Application No. 201310714536.5, 23 pgs.
European Office Action dated Jul. 4, 2017 in related European Application No. 13 198 895.8.
European Patent Office Communication dated Sep. 12, 2016 from European Patent Application No. 13198895.8, 5 pages.
Extended European Search Report dated May 3, 2016 from European Patent Application No. 13198895.8, 11 pages.
U.S. Office Action dated May 31, 2016 from U.S. Appl. No. 14/136,008.
U.S. Notice of Allowance dated Oct. 4, 2016 from U.S. Appl. No. 14/136,008.
U.S. Appl. No. 14/136,008, filed Dec. 20, 2013, Seong Cheol Moon, Samsung Electronics Co., Ltd.
Chinese Notice of Allowance dated Jun. 26, 2018 in corresponding Chinese Patent Application No. 201310714536.5, 5 pgs.
Korean Office Action dated Sep. 18, 2018 in Korean Patent Application No. 10-2012-0150580.

* cited by examiner

GAS OVEN

CROSS-REFERENCE TO RELATED APPLICATIONS

This application is a continuation of U.S. application Ser. No. 14/136,008 filed on Dec. 20, 2013, which claims the benefit of the Korean Patent Application No. 10-2012-0150580, filed on Dec. 21, 2012, in the Korean Intellectual Property Office, the disclosures of which are incorporated herein by reference.

BACKGROUND

1. Field

Embodiments of the present disclosure relate to a gas oven configured to use a cooking cavity divided into a plurality of individual cooking cavities by a divider.

2. Description of the Related Art

A gas oven is an home appliance provided with a cooking cavity in which a food substance is accommodated, a burner configured to generate heat by combusting gas and air to cook the food substance accommodated in the cooking cavity by applying heat at high temperature, a gas supplying passage configured to supply gas to the burner, and an ignition device configured to generate a spark.

As is widely known, air is needed for combustion to occur, and after the combustion occurs, combustion gas, which is waste gas, is generated, and thus the gas oven is further provided with an air supplying passage configured to supply air to the cooking cavity, and an air discharging passage configured to discharge waste gas of the cooking cavity.

The air supplying passage and the air discharging passage allow an inside of the cooking cavity to communicate with an outside of the body of the gas oven. At this time, by the difference in density, warm air is ascended and cold air is descended, and thus the air supplying passage is provided in a way to communicate at a lower portion of the cooking cavity, and the air discharging passage is provided in a way to communicate at an upper portion of the cooking cavity.

SUMMARY

Therefore, it is an aspect of the present disclosure to provide a gas oven configured to cook a cooking substance by using a whole area of a cooking cavity or by dividing a cooking cavity into a plurality of individual cooking cavities and using at least one of the plurality of individual cooking cavities.

It is another aspect of the present disclosure to provide a gas oven, having a plurality of burners respectively provided at an upper portion and a lower portion of a cooking cavity of the gas oven, capable of simultaneously operating the plurality of burners.

Additional aspects of the disclosure will be set forth in part in the description which follows and, in part, will be apparent from the description, or may be learned by practice of the disclosure.

In accordance with an embodiment of the present disclosure, a gas oven includes a body, a cooking cavity, a first burner, a second burner, a main air supplying passage, a main air discharging passage, a subsidiary air supplying device, and a subsidiary air discharging device. The cooking cavity may be formed at an inside of the body and formed to be dividable by a divider detachably mounted at the cooking cavity into a first individual cooking cavity at an upper portion of the body and a second individual cooking cavity at a lower portion of the body. The first burner may be provided at the first individual cooking cavity. The second burner may be provided at the second individual cooking cavity. The main air supplying passage may be configured to communicate the second individual cooking cavity with an outside of the body to supply air to the second individual cooking cavity. The main air discharging passage may be configured to communicate the first individual cooking cavity with the outside of the body to discharge waste gas of the first individual cooking cavity. The subsidiary air supplying device, in a case when the divider is mounted at the cooking cavity or in a case when the first burner and the second burner are simultaneously operated, may be configured to supply air to the first individual cooking cavity, and in a case when the first burner and the second burner are simultaneously operated, may be configured to forcedly supply air to the first individual cooking cavity. The subsidiary air discharging device, in a case when the divider is mounted at the cooking cavity, may be configured to discharge waste air of the second individual cooking cavity.

The subsidiary air supplying device may include a subsidiary air supplying passage configured to communicate the first individual cooking cavity with the outside of the body, an air supplying damper to open/close the subsidiary air supplying passage, and an air supplying fan configured to forcedly move air.

The gas oven may further include an air supplying duct configured to form the subsidiary air supplying passage. The first burner may include an inlet hole disposed at an inside of the air supplying duct in a way that at least a portion of air that flows at an inside of the air supplying duct is introduced to an inside of the first burner.

The air supplying duct may include an overflow hole provided in a way that a remaining portion of the air that flows at the inside of the air supplying duct escapes to an outside of the air supplying duct to flow to surround the first burner.

In a case when the divider is separated from the cooking cavity and one of the first burner and the second burner is operated, the subsidiary air supplying device may shut off the subsidiary air supplying passage.

In a case when a self cleaning of the gas oven is performed, the subsidiary air supplying device may shut off the subsidiary air supplying passage.

The subsidiary air discharging device may include a subsidiary air discharging passage configured to communicate the second individual cooking cavity with an outside of the body, and an air discharging damper to open/close the subsidiary air discharging passage.

The subsidiary air discharging passage may be separately provided from the main air discharging passage, or join the main air discharging passage at one point of the main air discharging passage.

In a case when the divider is separated from the cooking cavity, the subsidiary air discharging device may shut off the subsidiary air discharging passage.

In a case when a self cleaning of the gas oven is being performed, the subsidiary air discharging device may shut off the subsidiary air discharging passage.

In accordance with another aspect of the present disclosure, a gas oven includes a body, a cooking cavity, a first burner, a second burner, a first air supplying passage, a first air discharging passage, a second air supplying passage, a second air discharging passage, an air supplying damper, an air supplying fan and an air discharging damper. The cooking cavity may be formed at an inside of the body and formed to be dividable by a divider detachably mounted at the cooking cavity into a first individual cooking cavity at an upper portion of the body and a second individual cooking cavity at a lower portion of the body. The first burner may be provided at the first individual cooking cavity. The second burner may be provided at the second individual cooking cavity. The first air supplying passage may be configured to communicate the first individual cooking cavity with an outside the body to supply air to the first individual cooking cavity. The first air discharging passage may be configured to communicate the first individual cooking cavity with an outside of the body to discharge waste gas of the first individual cooking cavity. The second air supplying passage may be configured to communicate the second individual cooking cavity with an outside of the body to supply air to the second individual cooking cavity. The second air discharging passage may be configured to communicate the second individual cooking cavity with an outside of the body to discharge waste gas of the second individual cooking cavity. The air supplying damper may be configured to open/close the first air supplying passage, depending on whether the divider is attached/detached. The air supplying fan may be configured to forcedly move air at an outside the body to the first individual cooking cavity through the first air supplying passage, depending on whether the first burner and the second burner are simultaneously operated. The air discharging damper may be configured to open/close the second air discharging passage, depending on whether the divider is attached/detached. Further, the gas oven may have a first mode during which the divider is mounted and only the first burner is operated, a second mode during which the divider is mounted and only the second burner is operated, a third mode during which the divider is mounted and the first burner and the second burner are simultaneously operated, a fourth mode during which the divider is separated and only the first burner is operated, a fifth mode during which the divider is separated and only the second burner is operated, and a sixth mode during which the divider is separated and the first burner and the second burner are simultaneously operated.

In the first mode, the air supplying damper may be open so that air is supplied to the first individual cooking cavity.

In the second mode, the air discharging damper may be open so that waste air of the second individual cooking cavity is discharged.

In the third mode, the air supplying damper may be open and the air supplying fan may be operated so that air is forcedly supplied to the first individual cooking cavity, and the air discharging damper is open so that waste gas of the second individual cooking cavity is discharged.

In the fourth mode and the fifth mode, the air supplying damper and the air discharging damper may be shut off, so that heat of the cooking cavity is prevented from being discharged through the second air supplying passage and the second air discharging passage.

In the sixth mode, the air supplying damper may be open and the air supplying fan may be operated so that air is forcedly supplied to the first individual cooking cavity, and the air discharging damper is closed so that heat of the second individual cooking cavity is prevented from being discharged through the second air discharging passage.

When a self cleaning of the gas oven is performed, the air supplying damper and the air discharging damper may be shut off, so that heat of the cooking cavity is prevented from being discharged through the second air supplying passage and the second air discharging passage.

In accordance with another aspect of the present disclosure, a gas oven includes a body, a cooking cavity, a first burner, a second burner, a main air supplying passage, a main air discharging passage and a forced air supplying device. The cooking cavity may be formed at an inside of the body. The first burner may be provided at an upper portion of the cooking cavity. The second burner may be provided at a lower portion of the cooking cavity. The main air supplying passage may be connected to a lower portion of the cooking cavity to supply air to the cooking cavity. The main air discharging passage may be connected to an upper portion of the cooking cavity to discharge waste gas of the cooking cavity to an outside of the body. The forced air supplying device may be configured to forcedly supply air to the first burner so that incomplete combustion by the waste gas generated at the second burner, in a case when the first burner and the second burner are simultaneously operated, is prevented from taking place at the first burner.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
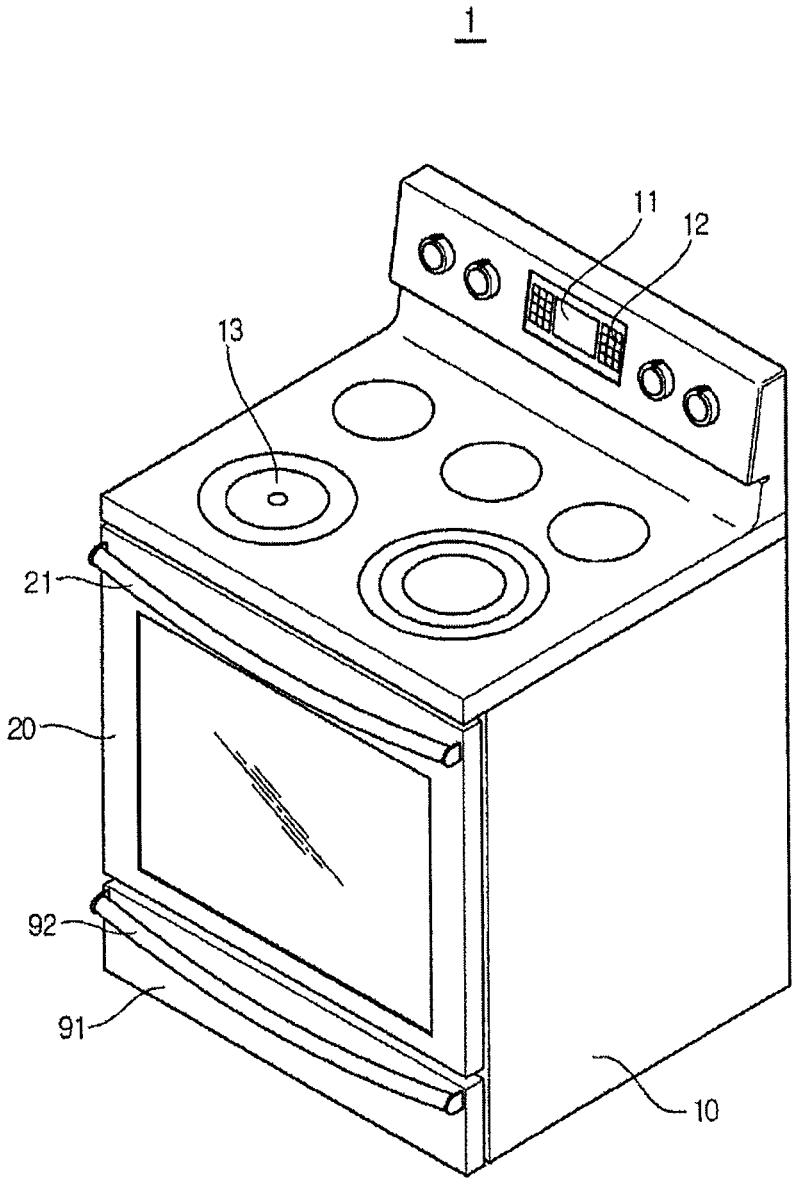
FIG. 1 is a drawing illustrating an exterior appearance of a gas oven in accordance with an embodiment of the present disclosure.

Reference will now be made in detail to the embodiments of the present disclosure, examples of which are illustrated in the accompanying drawings, wherein like reference numerals refer to like elements throughout.

Figure 2:
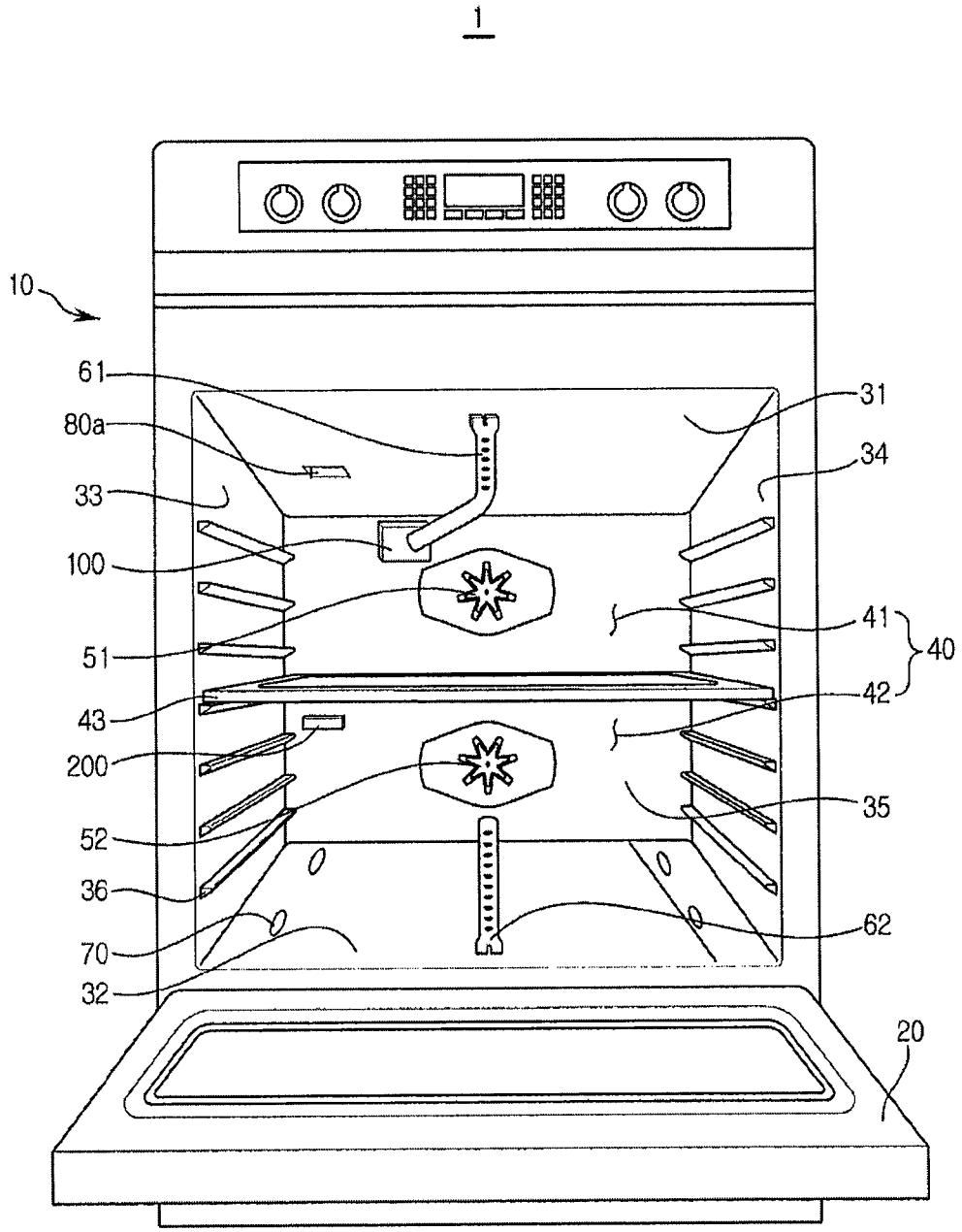
FIG. 2 is a drawing illustrating an inside the gas oven of FIG. 1.

FIG. 1 is a drawing illustrating an exterior appearance of a gas oven in accordance with an embodiment of the present disclosure, and FIG. 2 is a drawing illustrating an inside the gas oven of FIG. 1.

Referring to FIG. 1 and FIG. 2, a gas oven 1 includes a body 10, a cooking cavity 40 provided at an inside of the body to accommodate a food substance therein, a plurality of burners 61 and 62 to generate heat by combusting gas, and a plurality of convection fans 51 and 52 to convect air of the cooking cavity 40.

The cooking cavity 40 is formed in an approximate box shape by an upper portion wall 31, a lower portion wall 32, a left side wall 33, a right side wall 34, and a rear wall 35, and is provided with a front surface thereof open for the input/output of a cooking substance. The open front surface of the cooking cavity 40 may be open and closed by a door 20 hingedly coupled to the body 10 so as to be rotatable in an upper side and lower side direction. At the door 20, a handle 21 may be provided.

At an upper end of the body 10, a cook top unit 13 at which a container filled with a food substance may be placed and configured to apply heat to the container, a display 11 to display various operational information of the gas oven 1, and a manipulation unit 12 capable of manipulating the operation of the oven 1 may be provided.

Meanwhile, at an inside the cooking cavity 40, a plurality of supporters 36 to mount a rack (not shown) at which a food substance may be placed. The plurality of supporters 36 may be protrudedly provided form the left side wall 33 and the right side wall 34.

At the plurality of supporting fixtures 36, a divider 43 capable of dividing the cooking cavity 40 may be detachably mounted. The divider 43 may be horizontally mounted at the cooking cavity 40 to divide the cooking cavity 40 into an individual cooking cavity at an upper portion 41 and an individual cooking cavity at a lower portion 42.

Hereinafter, the individual cooking cavity at an upper portion 41 and the individual cooking cavity at a lower portion 42 will be referred to as a first individual cooking cavity 41 and a second individual cooking cavity 42, respectively. The first individual cooking cavity 41 and the second individual cooking cavity 42 are not necessarily needed to be the same in terms of size with respect to each other, and the size of the first individual cooking cavity 41 and the second individual cooking cavity 42 each may be different to each other. The divider 43 includes insulation material, and may insulate the first individual cooking cavity 41 from the second individual cooking cavity 42.

At the first individual cooking cavity 41, one of the plurality of burners 61 and 62 is provided, and at the second individual cooking cavity 42, the remaining one of the plurality of burners 61 and 62 is provided. Hereinafter, the burner 61 provided at the first individual cooking cavity 41 is referred to as a first burner 61, and the burner 62 provided at the second individual cooking cavity 42 is referred to as a second burner 62. Thus, the first burner 61 may radiate heat at the first individual cooking cavity 41, and the second burner 62 may radiate heat at the second individual cooking cavity 42.

In addition, at the first individual cooking cavity 41, one convection fan 51 of the plurality of convection fans 51 and 52 is provided, and at the second individual cooking cavity 42, the remaining one convection fan 52 of the plurality of convection fans 51 and 52 is provided. Thus, the convection fan 51 may convect the air of the first individual cooking cavity 41, and the convection fan 52 may convect the air of the second individual cooking cavity 42.

At a lower side of the cooking cavity 40, a storage compartment 90 configured to store a cookware may be provided. The storage compartment 90 may be open and closed by a drawer 91 configured to be inserted into and withdrawn from in a sliding manner. At the drawer 91, a handle 92 may be provided.

Meanwhile, the gas oven 1 is provided with a main air supplying passage 70 configured to communicate the second individual cooking cavity 42 with an outside the body 10 to supply air to the second individual cooking cavity 42. As is widely known, for combustion to take place, gas, air and arc are needed, and through the main air supplying passage 70, air for combustion may be supplied to the second individual cooking cavity 42. The main air supplying passage 70 may be formed by a penetrating hole 70*a* passing through the lower portion wall 32, the storage compartment 90, and a through hole 70*b* being formed through the rear wall 35.

The main air supplying passage 70, in a case when the divider 43 is mounted at the cooking cavity 40, may be able to supply air to the second individual cooking cavity 42, and in a case when the divider 43 is separated from the cooking cavity 40, the main air supplying passage 70 may be able to supply air to the entire are of the cooking cavity 40.

In addition, the gas oven 1 is provided with a main air discharging passage 80 configured to communicate the first individual cooking cavity 41 with an outside of the body 10 to discharge waste gas of the first individual cooking cavity 41. Here, the waste gas is referred to as the combustion gas that is generated after combustion, and in a case when gas is completely combusted, carbon monoxide and vapor are generated, and in a case when gas is not completely combusted, carbon monoxide, hydrogen and sulfur may be generated. When the waste gas as such remains without being discharged, incomplete combustion is generated at the burner, and thus waste gas needs to be discharged to an outside.

The main air discharging passage 80 may be formed by an air discharging hole 80*a* passing through the upper portion wall 31 and an air discharging duct 80*b* communicating the air discharging hole 80*a* with an outside of the body 10.

The main air discharging passage 80, in a case when the divider 43 is mounted at the cooking cavity 40, may be able to discharge waste air of the first individual cooking cavity 41, and in a case when the divider 43 is separated from the cooking cavity 40, the main air discharging passage 80 may be able to discharge waste air of the entire are of the cooking cavity 40.

In addition, the gas oven 1 is provided with a subsidiary air supplying device 100 configured to supply air to the first individual cooking cavity 41 naturally or forcedly. Fundamentally, the subsidiary air supplying device 100 is configured to supply air to the first individual cooking cavity 41 in a case when the divider 43 is mounted at the cooking cavity 40.

This is because, in a case when the divider 43 is mounted at the cooking cavity 40, the air being supplied to the second individual cooking cavity 42 through the main air supplying passage 70 is blocked from being moved to the first individual cooking cavity 41.

Furthermore, the subsidiary air supplying device 100, in a case when the first burner 61 and the second burner 62 are simultaneously operated, supplies air to the first individual cooking cavity 41. Particularly, in the case as such, the subsidiary air supplying device 100 forcedly supplies air to the first individual cooking cavity 41. In the aspect as such, the subsidiary air supplying device 100 may be referred to as a forced air supplying device 100. The detailed structure and functionality of the subsidiary air supplying device 100 will be described later.

In addition, the gas oven 1 is provided with a subsidiary air discharging device 200 configured to discharge waste gas of the second individual cooking cavity 42. The subsidiary air discharging device 200 is configured to discharge waste air of the second individual cooking cavity 42 in a case when the divider 43 is mounted at the cooking cavity 40.

This is because, in a case when the divider 43 is mounted at the cooking cavity 40, the waste air of the second individual cooking cavity 42 may not be able to be discharged through the main air discharging passage 80. The detailed structure and functionality of the subsidiary air discharging device 200 will be described later.

Figure 3:
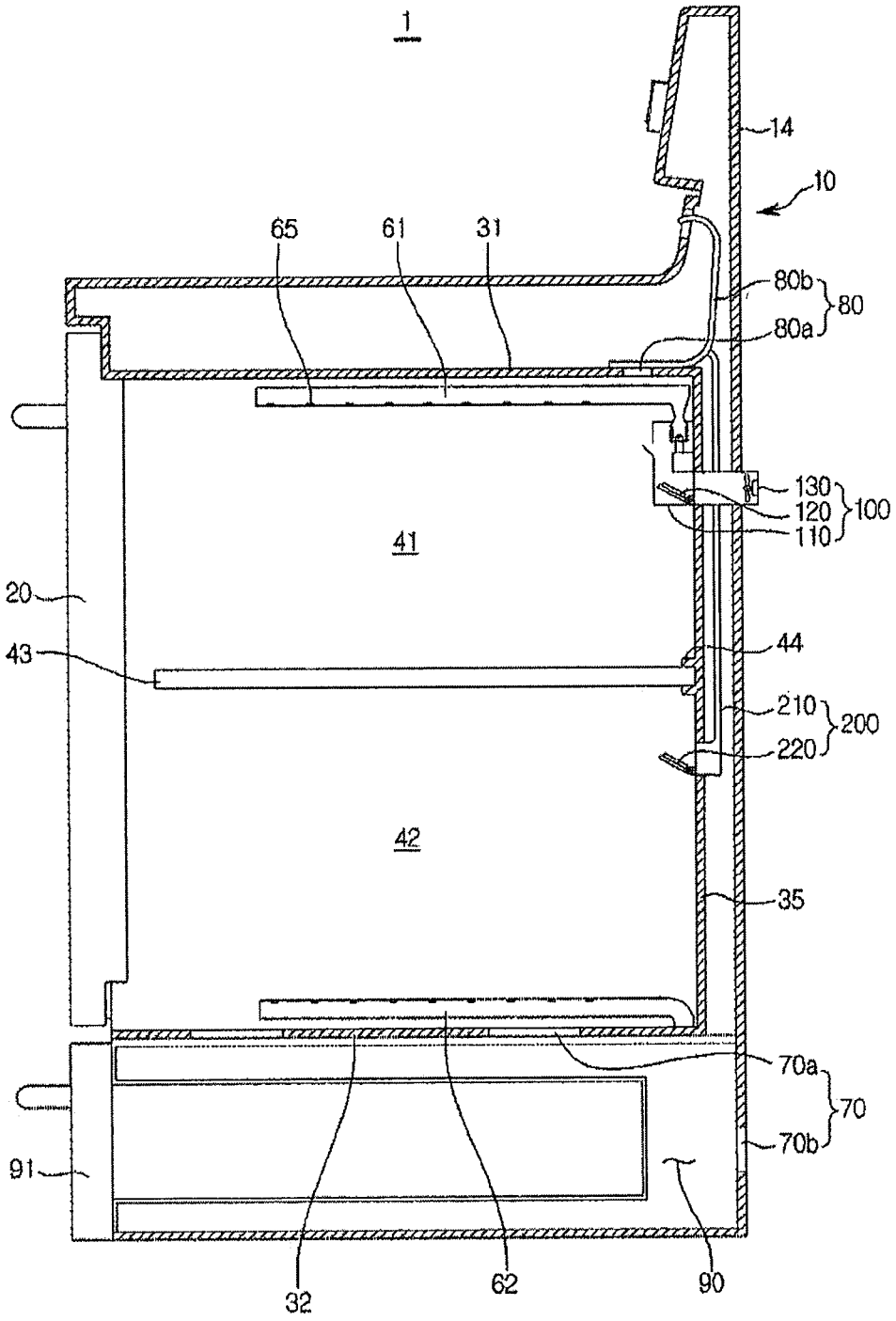
FIG. 3 is a schematic side sectional view of the gas oven of FIG. 1.
Figure 4:
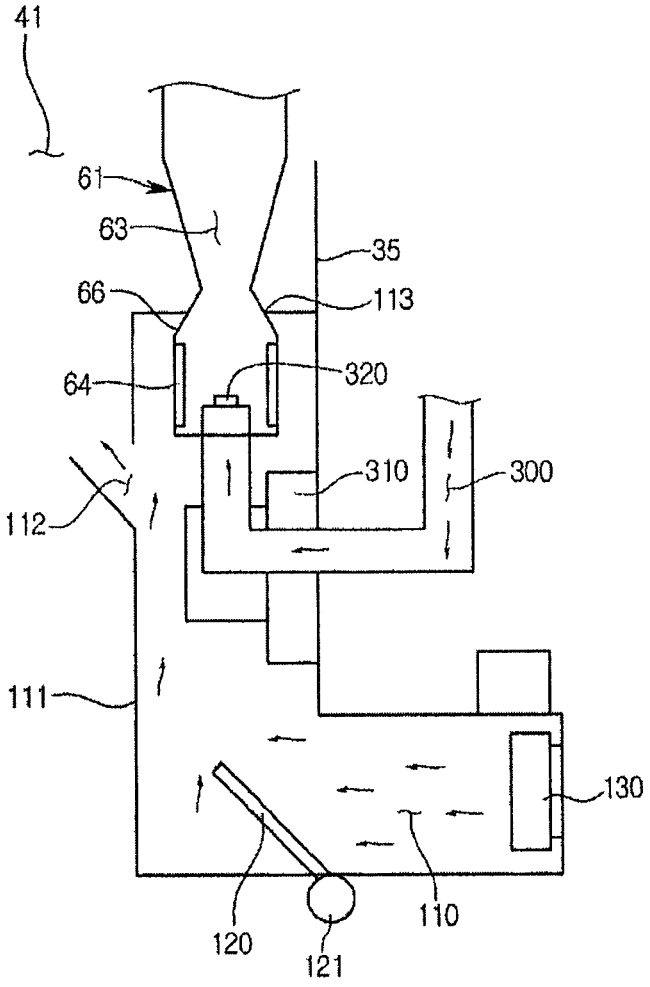
FIG. 4 is a drawing illustrating a subsidiary air supplying device of the gas oven of FIG. 1.
Figure 5:
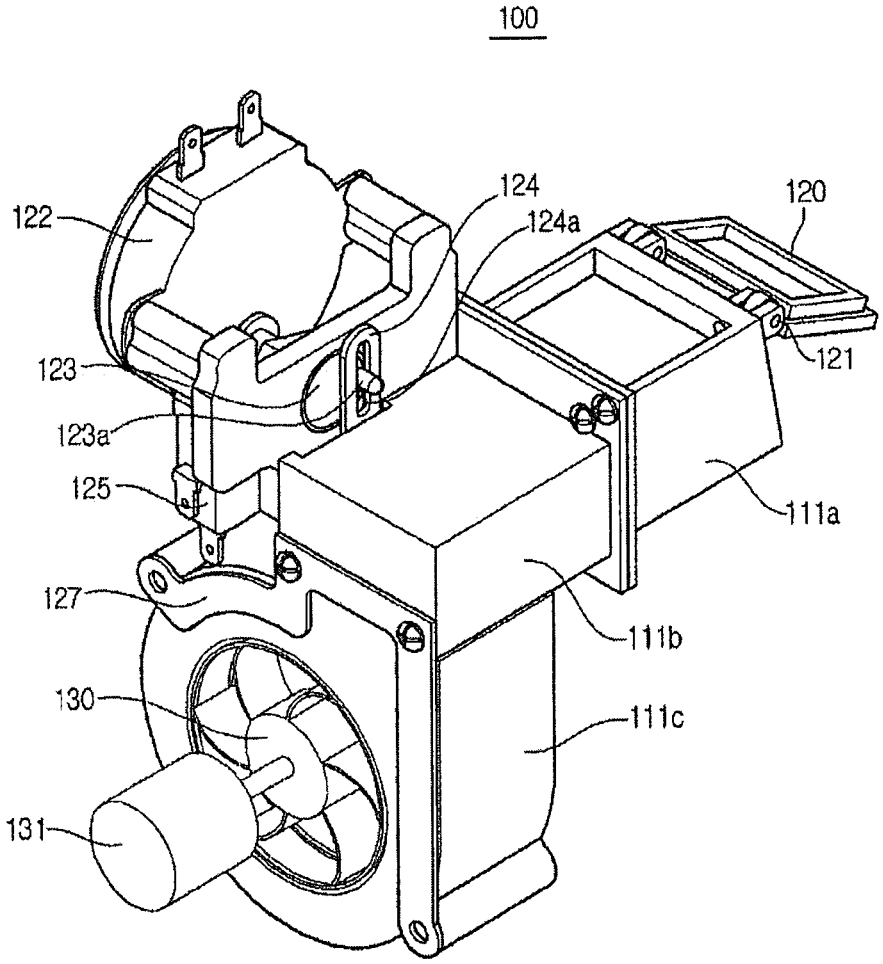
FIG. 5 is a drawing of an example of implementation of the subsidiary air supplying device of the gas oven of FIG. 1.
Figure 6:
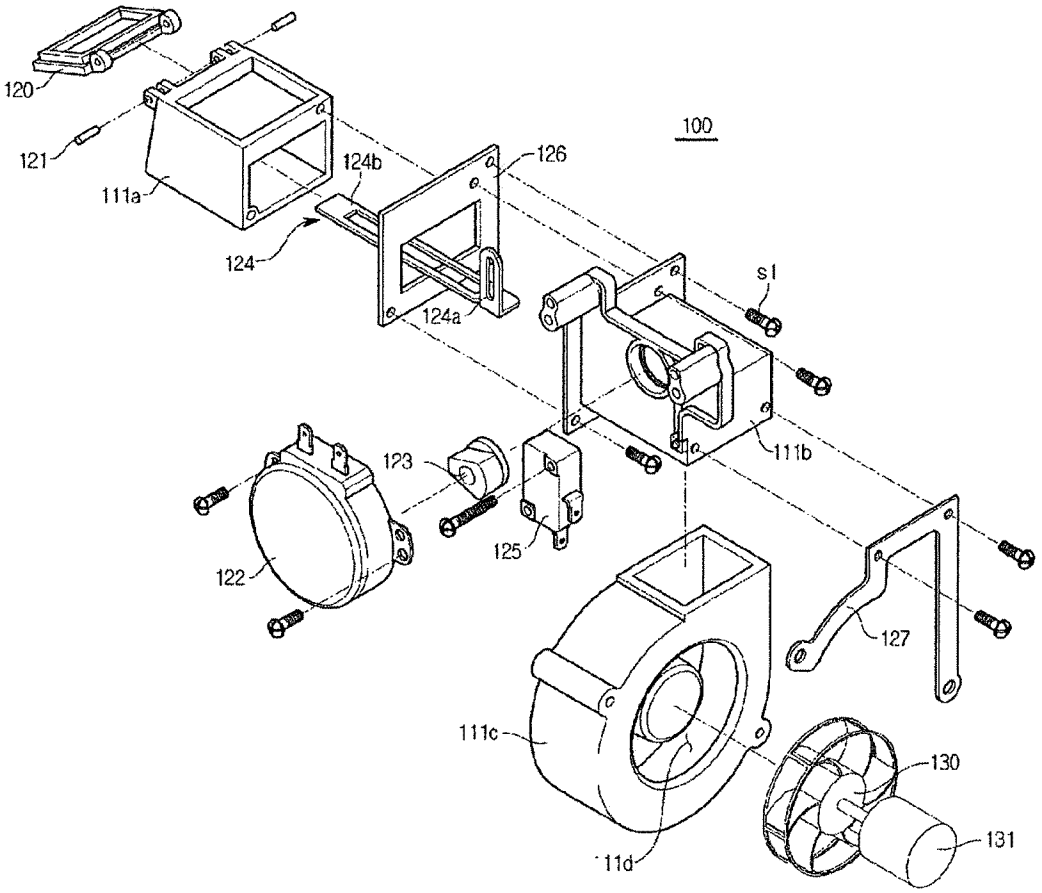
FIG. 6 is an exploded drawing illustrating the subsidiary air supplying device of FIG. 5.

FIG. 3 is a schematic side sectional view of the gas oven of FIG. 1, FIG. 4 is a drawing illustrating a subsidiary air supplying device of the gas oven of FIG. 1, FIG. 5 is a drawing of an example of implementation of the subsidiary air supplying device of the gas oven of FIG. 1, and FIG. 6 is an exploded drawing illustrating the subsidiary air supplying device of FIG. 5.

Referring to FIGS. 3 and 6, the subsidiary air supplying device 100 may include a subsidiary air supplying passage 110 configured to communicate the first individual cooking cavity 41 with an outside of the body 10, an air supplying damper 120 to open/close the subsidiary air supplying passage 110, and an air supplying fan 130 configured to forcedly move the air at an outside the cooking cavity 40 to the first individual cooking cavity 41 through the subsidiary air supplying passage 110.

The subsidiary air supplying passage 110 may be able to pass through both the rear wall 35 of the cooking cavity 40 and an outside case 14 of the body 10. The subsidiary air supplying passage 110 may be formed at an inside an air supplying duct 111 (FIG. 4). A portion of the air supplying duct 111 may be disposed at the first individual cooking cavity 41. At the air supplying duct 111, an insertion hole 113 into which the first burner 61 is inserted is provided, and through the insertion hole 113, a head part 66 of the first burner 61 may be inserted into an inside the air supplying duct 111.

Gas and air may be introduced to an inside space 63 of the first burner 61 through the head part 66. The gas is guided to an inside the head part 66 through a gas supplying passage 300, and may be jetted to the inside space 63 of the first burner 61 through a nozzle 320 provided at an end portion of the gas supplying passage 300. The gas supplying passage 300 may be fixed to the rear wall 35 by a holder 310.

When the gas is jetted to the inside space 63 of the first burner 61 through the nozzle 320, a portion of the air inside the air supplying duct 111 may be drawn into the inside space 63 of the first burner 61 together with the gas through the inlet hole 64 formed at the head part 66.

The gas and air being introduced to the inside space 63 of the first burner 61 are mixed at the inside space 63 of the first burner 61, and may be discharged through an outlet hole 65 (FIG. 3) of the first burner 61. The mixed gas may be combusted by the arc that is ignited at an ignition device (not shown). At this time, the air being introduced to the first burner 61 together with the gas may be referred to as a first air.

Meanwhile, the remaining portion of the air inside the air supplying duct 111 may be supplied to the first individual cooking cavity 41 after escaping from the air supplying duct 111 through an overflow hole 112 formed at the air supplying duct 111.

The air being supplied to the first individual cooking cavity 41 through the overflow hole 112 flows to the surroundings of the outlet hole 65 of the first burner 61 to be mixed and combusted with the gas being discharged through the outlet hole 65. At this time, as the above, the air that flows to the surroundings of the outlet hole 65 of the first burner 61 through the overflow hole 112 may be referred to as a second air.

Thus, the first burner 61 generates combustion by receiving the first air and the second air.

Meanwhile, the air supplying fan 130 forcedly sucks the air from an outside of the cooking cavity 40 and moves the air to an inside of the first burner 61 or to the surroundings of the first burner 61. As the above, the air supplying fan 130 forcedly flows air as to have the first burner 61 and the second burner 62 operate in a simultaneous manner.

This is because, in a case when the first burner 61 and the second burner 62 simultaneously operate, the waste gas generated from the second burner 62 ascends to move to the surroundings of the first burner 61, and by the waste gas introduced to the surroundings of the first burner 61 as the above, incomplete combustion takes place at the first burner 61. From a different perspective, the supply of the second air to the first burner 61 becomes difficult due to the waste gas of the second burner 62.

Thus, for the first burner 61 and the second burner 62 to simultaneously operate, the amount of a portion of the air being forcedly supplied by the air supplying fan 130, which is discharged through the overflow hole 112, needs to be sufficient to push out the waste gas of the second burner 62 to the air discharging passage 80.

Meanwhile, not to mention the case when the divider 43 is separated from the cooking cavity 40, in a case when the divider 43 is mounted at the cooking cavity 40, a forced supply of air is needed by the air supplying fan 130. This is because, even in a case when the divider 43 is mounted at the cooking cavity 40, the waste gas of the second burner 62 may be introduced to the surroundings of the first burner 61 through a gap in between the divider 43 and the door 20 and a gap in between the divider 43 and both side walls 33 and 34 (FIG. 2), as well as through a gap in between the divider 43 and the rear wall 35.

Meanwhile, in a case when the divider 43 is separated from the cooking cavity 40 and when one of the first burner 61 and the second burner 62 is operated, the air supplying damper 120 needs to shut off the subsidiary air supplying passage 110. This is because, in the case as such, the supplying of air to the cooking cavity 40 takes place through the main air supplying passage 70 and the discharging of the waste gas of the cooking cavity 40 may take place through the main air discharging passage 80, and in a case when the subsidiary air supplying passage 110 is open, a high-temperature waste gas of the cooking cavity 40 may be excessively discharged.

In addition, in a case when the gas oven 1 performs a self cleaning at high temperature, the air supplying damper 120 needs to shut off the subsidiary air supplying passage 110.

Meanwhile, the subsidiary air supplying device 100 may be specified within the limit where the technical aspects of the present disclosure may be achieved. On FIG. 5 and on FIG. 6, an example of the subsidiary air supplying device 100 is illustrated.

As illustrated on FIGS. 5 and 6, the subsidiary air supplying device 100 may include the air supplying duct 111 forming the subsidiary air supplying passage 110, the air supplying damper 120 to open/close the subsidiary air supplying passage 110, a damper driving motor 122 to drive the air supplying damper 120, the air supplying fan 130 to forcedly flow air, a fan motor 131 to drive the air supplying fan 130, and a detection switch 125 to detect the operational status of the air supplying damper 120.

The air supplying duct 111 may include a first duct part 111*a*, a second duct part 111*b*, and a third duct part 111*c*. The first duct part 111*a*, the second duct part 111*a*, and the third duct part 111*c* may be connected to one another. The first duct part 111*a* may be disposed between the rear wall 35 (FIG. 3) and the outside case 14 (FIG. 3), and the second duct part 111*b* and the third duct part 111*c* may be disposed at an outside of the outside case 14.

The air supplying duct 111 may further include a mixed flow duct part (not shown) connected to the first duct part 111*a* and disposed at an inside the first individual cooking cavity 41. Into the mixed flow duct part, the gas supplying passage 300 (FIG. 4) and the first burner 61 may be inserted. At the mixed flow duct part the overflow hole 112 may be formed.

The first duct part 111*a* and the second duct part 111*b* each may be coupled to a supporting bracket 126. The supporting bracket 126 may be coupled to the outside case 14 (FIG. 3) by a coupling member 'S1'.

The air supplying damper 120 may be rotatably coupled to the first duct part 111*a* while having a hinge shaft 121 as a center of the rotation. The air supplying damper 120 may be provided to be disposed at an inside the first individual cooking cavity 41, or may be provided to be disposed in between the rear wall 35 (FIG. 3) and the outside case 14 (FIG. 3).

The damper driving motor 122 to drive the air supplying damper 120 may be coupled to the second duct part 111*b*. To an output shaft of the damper driving motor 122, a rotating lever 123 having an approximate cylinder shape is coupled, so that the rotating lever 123 may be able to rotate at the time when the damper driving motor 122 is operated.

The rotating lever 123 includes an insertion bar 123*a* protruding from a location spaced apart by a predetermined distance from a rotating shaft thereof, and the insertion bar 123*a* may be inserted into an insertion hole 124*a* formed at a pressing lever 124. At this time, the insertion hole 124*a* of the pressing lever 124 is formed in lengthways in the vertical direction, so that the rotating motion of the rotating lever 123 may be converted into a linear motion toward the horizontal direction of the pressing lever 124.

The pressing lever 124 includes a pressing bar 124*b* formed in lengthways in approximately the horizontal direction, and the pressing bar 124*b* is provided to be in contact with the air supplying damper 120. Thus, according to the rotational direction of the rotating lever 123, the pressing bar 124*b* of the pressurizing lever 124 may move toward a direction in which the air supplying damper 120 is pushed, or toward a direction opposite to a direction in which the air supplying damper 120 is pushed.

When the pressing bar 124*b* of the pressing lever 124 pushes the air supplying damper 120, the air supplying damper 120 may be open, and when the pressing lever 124 is moved toward an opposite direction to the direction in which the air supplying damper 120 is pushed, the air supplying damper 120 may be closed by the self gravity thereof.

The detection switch 125 may be coupled to the second duct part 111*b* to detect whether or not the air supplying damper 120 is open or the degree of opening of the air supplying damper 120. The detection switch 125, by measuring the rotational direction and the amount of rotation of the rotating lever 123, may be able to detect whether or not the air supplying damper 120 is open or the degree of opening of the air supplying damper 120.

The third duct part 111*c* may be provided with the shape of a scroll, and may be coupled to the second duct part 111*b* by a coupling bracket 127. At a fan installing part 111*d* of the third duct part 111*c*, the air supplying fan 130 may be installed. The air supplying fan 120 may be a centrifugal fan.

Referring to FIG. 3 again, the subsidiary air discharging device 200 may include a subsidiary air discharging passage 210 configured to communicate the second individual cooking cavity 42 with an outside the cooking cavity 40, and an air discharging damper 220 configured to open and close the subsidiary air discharging passage 210.

The subsidiary air discharging passage 210 may join the main air discharging passage 80 while being vertically extended at a space in between the rear wall 35 of the cooking cavity 40 and the outside case 14 of the body 10. However, differently from the previous embodiments, the subsidiary air discharging passage 210 may be independently extended to an outside the body 10 without joining the main air discharging passage 80. Through the structure as the above, the waste gas of the second individual cooking cavity 42 may be discharged to an outside of the body 10.

Meanwhile, in a case when the divider 43 is separated from the cooking cavity 40, the air discharging damper 220 needs to shut off the subsidiary air discharging passage 210, since in the case as such, the waste gas of the cooking cavity 40 may be discharged through the main air discharging passage 80, and when the subsidiary air discharging passage 210 is open, the high-temperature waste gas of the cooking cavity 40 may be excessively discharged through the subsidiary air discharging passage 210.

In addition, in a case when the gas oven 1 performs a self cleaning at high temperature, the air discharging damper 220 needs to shut off the subsidiary air discharging passage 210.

Meanwhile, the subsidiary air discharging device 200 may be specified within the limit where the technical aspects of the present disclosure may be achieved. On FIG. 7 and on FIG. 8, an example of the subsidiary air discharging device 200 is illustrated.

Figure 7:
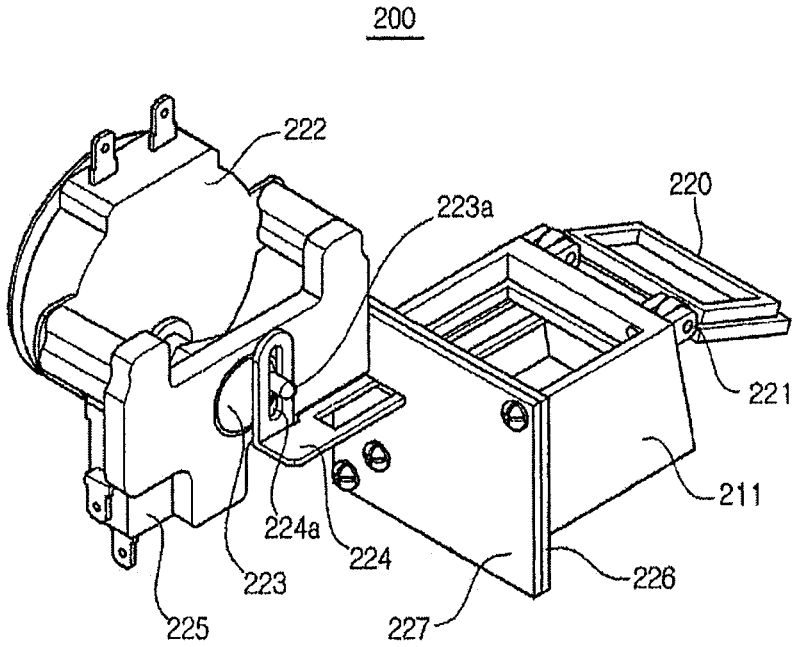
FIG. 7 is a drawing of an example of implementation of a subsidiary air discharging device of the gas oven of FIG. 1.
Figure 8:
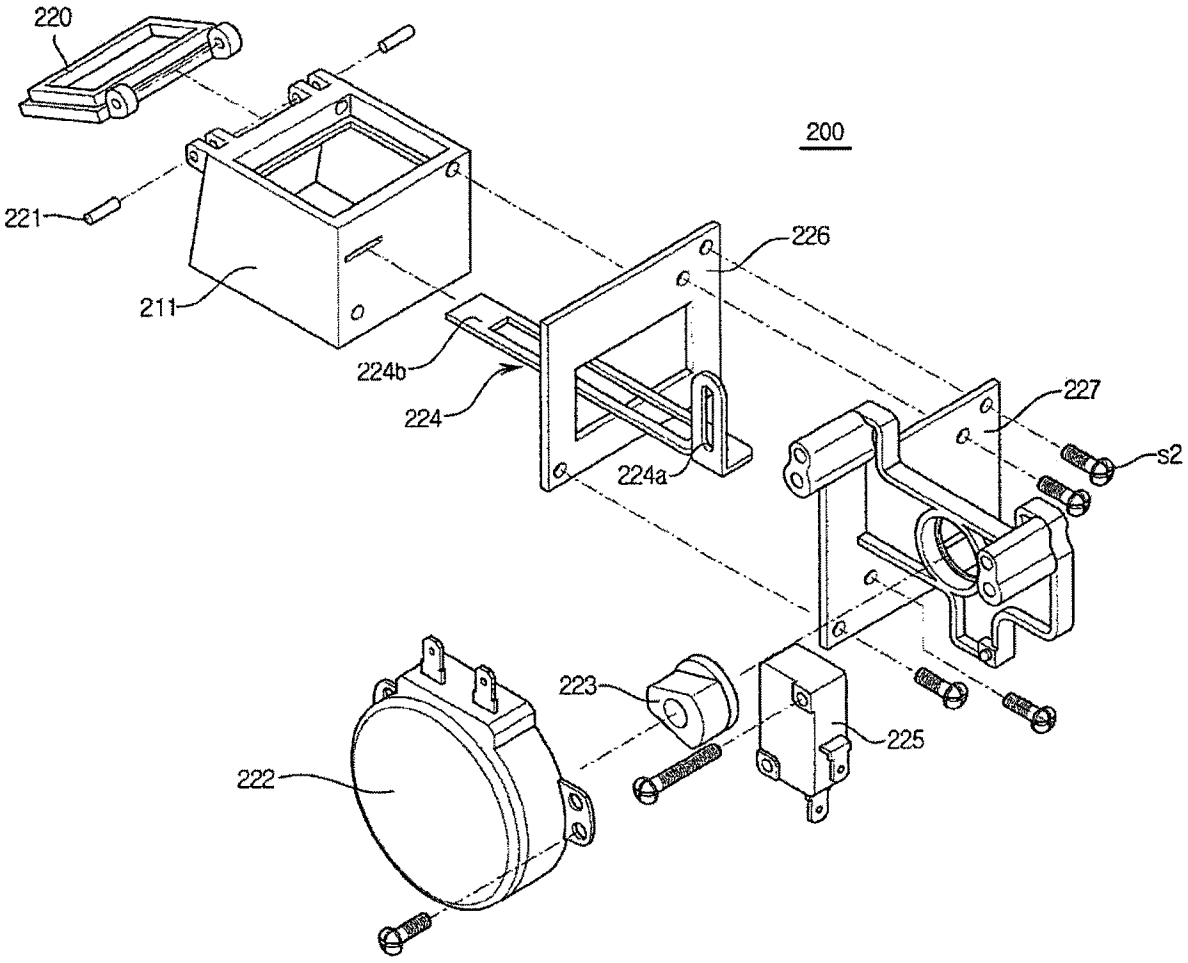
FIG. 8 is an exploded drawing illustrating the subsidiary air discharging device of FIG. 7.

As illustrated on FIGS. 7 and 8, the subsidiary air discharging device 200 may include an air discharging duct part 211 forming the subsidiary air discharging passage 210, the air discharging damper 220 to open/close the subsidiary air discharging passage 210, a damper driving motor 222 to drive the air discharging damper 220, and a detection switch 225 to detect the operational status of the air discharging damper 220.

The air discharging duct part 211 may be disposed in between the rear wall 35 (FIG. 3) and the outside case 14 (FIG. 3). The subsidiary air discharging device 200 may further include an extension duct part (not shown) connecting the air discharging duct 211 to the main air discharging passage 80 or connecting the air discharging duct part 211 to an outside of the body 10. The air discharging duct part 211 may form the subsidiary air discharging passage 210 in cooperation with the extension duct part.

The air discharging duct part 211 may be coupled to a supporting bracket 226. The supporting bracket 126 may be coupled to the rear wall 35 (FIG. 3) by a coupling member 'S2'.

The air discharging damper 220 may be rotatably coupled to the air discharging duct part 211 while having a hinge shaft 221 as a center of the rotation. The air discharging damper 220 may be provided to be disposed at an inside the second individual cooking cavity 42, or may be provided to be disposed in between the rear wall 35 (FIG. 3) and the outside case 14 (FIG. 3).

The damper driving motor 222 to drive the air discharging damper 220 may be coupled to a coupling bracket 227. To an output shaft of the damper driving motor 222, a rotating lever 223 having an approximate cylinder shape is coupled, so that the rotating lever 223 may be able to rotate at the time when the damper driving motor 222 is operated.

The rotating lever 223 includes an insertion bar 223*a* protruded from a location spaced apart by a predetermined distance from a rotating shaft thereof, and the insertion bar 223*a* may be inserted into an insertion hole 224*a* formed at a pressing lever 224. At this time, the insertion hole 224*a* of the pressing lever 224 is formed lengthways in a vertical direction, so that the rotating motion of the rotating lever 223 may be converted into a linear motion toward the horizontal direction of the pressing lever 224.

The pressing lever 224 includes a pressing bar 224*b* formed lengthways in approximately the horizontal direction, and the pressing bar 224*b* is provided to be in contact with respect to the air discharging damper 220. Thus, according to the rotational direction of the rotating lever 223, the pressing bar 224*b* of the pressing lever 224 may move toward a direction in which the air discharging damper 220 is pushed, or toward a direction opposite to the direction in which the air discharging damper 220 is pushed.

When the pressing bar 224*b* of the pressing lever 224 pushes the air discharging damper 220, the air discharging damper 220 may be open, and when the pressing lever 224 is moved toward an opposite direction to the direction in which the air discharging damper 220 is pushed, the air discharging damper 220 may be closed by the self gravity thereof.

The detection switch 225 may be able to detect whether or not the air discharging damper 220 is open or the degree of opening of the air discharging damper 220 while being coupled to the coupling bracket 227. The detection switch 225, by measuring the rotational direction and the amount of rotation of the rotating lever 223, may be able to detect whether or not the air discharging damper 220 is open or the degree of opening of the air discharging damper 220.

Figure 9:
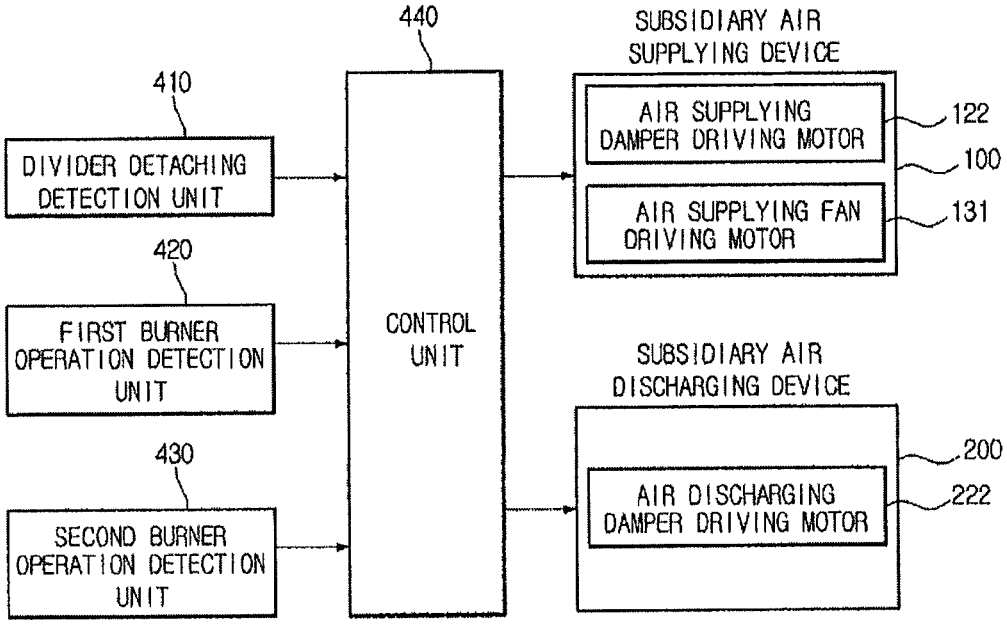
FIG. 9 is a control block diagram of the subsidiary air supplying device and the subsidiary air discharging device of the gas oven of FIG. 1.

FIG. 9 is a control block diagram of the subsidiary air supplying device and the subsidiary air discharging device of the gas oven of FIG. 1. Hereafter, referring to FIGS. 1 to 9, the operation and the control method of the gas oven in accordance with the embodiment of the present disclosure will be described.

The subsidiary air supplying device 100 and the subsidiary air discharging device 200 are selectively driven, depending on whether the divider 43 is mounted, the first burner 61 is operated, and the second burner 62 is operated.

For the above, the gas oven 1 includes a divider detaching detection unit 410 to detect whether or not the divider 43 is mounted, a first burner operation detection unit 420 to detect whether or not the first burner 61 is operated, a second burner operation detection unit 430 to detect whether or not the second burner 62 is operated, and a control unit 440 configured to drive the subsidiary air supplying device 100 and the subsidiary air discharging device 200 according to whether the divider 43 is mounted, the first burner 61 is operated, and the second burner 62 is operated.

The divider detaching detection unit 410 may include a divider detection switch 44 (FIG. 3). The divider detection switch 44, through the physical pressure applied by the divider 43, may be able to detect whether or not the divider 43 is mounted.

The operation of the first burner 61 and the second burner 62 may be selected by the choice of a user, and thus, the first burner operation detection unit 420 and the second burner operation detection unit 430 may be able to detect whether or not the first burner 61 and the second burner 62 are operated, respectively, through a manipulation signal that is input to the manipulation unit 12.

Thus, the gas oven 1 may be used under the total of six modes, depending on whether or not the divider 43 is mounted, and the first burner 61 and the second burner 62 are operated.

That is, the gas oven 1 may have a first mode during which the divider 43 is mounted and only the first burner 61 is operated, a second mode during which the divider 43 is mounted and only the second burner 62 is operated, a third mode during which the divider 43 is mounted and the first burner 61 and the second burner 62 are simultaneously operated, a fourth mode during which the divider 43 is separated and only the first burner 61 is operated, a fifth mode during which the divider 43 is separated and only the second burner 62 is operated, and a sixth mode during which the divider 43 is separated and the first burner 61 and the second burner 62 are simultaneously operated.

The opening/closing of the air supplying damper 120, the operation of the air supplying fan 130, and the opening/closing of the air discharging damper 220 at each mode may be summarized as below.

| Modes | Mounting of Divider/ Operation of First Burner and Second Burner | Air Supplying Damper | Air Supplying Fan | Air Discharging Damper |
|---|---|---|---|---|
| First Mode | Divider is mounted/ Only First Burner is operated | Open | | |
| Second Mode | Divider is mounted/ Only Second Burner is operated | | | Open |
| Third Mode | Divider is mounted/ Both First Burner and Second Burner are operated | Open | Operated | Open |
| Fourth Mode | Divider is separated/ Only First Burner is operated | Closed | | Closed |
| Fifth Mode | Divider is separated/ Only Second Burner is operated | Closed | | Closed |
| Sixth Mode | Divider is separated/ Both First Burner and Second Burner are operated | Open | Operated | Closed |

That is, in the first mode, the air supplying damper 120 is open so that air may be supplied to the first individual cooking cavity 41.

In the second mode, the air discharging damper 220 is open so that the waste air of the second individual cooking cavity 42 may be discharged.

In the third mode, the air supplying damper 120 is open and the air supplying fan 130 is operated so that air may be forcedly supplied to the first individual cooking cavity 41, and the air discharging damper 220 is open so that the waste air of the second individual cooking cavity 42 may be discharged.

In the fourth mode and the fifth mode, the air supplying damper 120 and the air discharging damper 220 are closed so that the heat of the cooking cavity 40 is prevented from being discharged through the subsidiary air supplying passage 110 and the subsidiary air discharging passage 210.

In the sixth mode, the air supplying damper 120 is open and the air supplying fan 130 so that air may be forcedly supplied to the first individual cooking cavity 41, and the air discharging damper 220 is closed so that the heat of the second individual cooking cavity 42 is prevented from being discharged through the subsidiary air discharging passage 210.

Through the operations as the above, the gas oven 1 in accordance with one aspect of the present disclosure may be able to perform a cooking using various cooking conditions by the reference and the need of a user.

Meanwhile, the aspect of the present disclosure is not limited to the gas oven 1 provided with the divider 43, and may be applied to a case of the gas oven 1 having the plurality of burners 61 and 62 without the divider 43. In a case of the conventional gas oven, the waste gas generated from the lower portion burner 62 flows to the surroundings of the upper portion burner 61, and as a result, incomplete combustion is occurred at the upper portion burner 61, and thus the plurality of burners 61 and 62 are not able to be simultaneously operated, but in accordance with the aspect of the present disclosure, by effectively supplying combustion-purpose air to the upper portion burner 61 through the subsidiary air supplying device 100, the plurality of burners 61 and 62 may be simultaneously operated.

As is apparent from the above description, foodstuff can be cooked by using a cooking cavity of the gas as a whole, or by dividing a cooking cavity into a plurality of individual cooking cavities and using at least one of the plurality of cooking cavities.

In addition, foodstuff can be cooked by simultaneously operating an upper burner and a lower burner that are provided at a cooking cavity.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A gas oven, comprising:

a body;

a cooking cavity formed inside the body, the cooking cavity divided by a divider detachably mounted in the cooking cavity into a first individual cooking cavity at an upper portion of the body and a second individual cooking cavity at a lower portion of the body;

a first burner provided at the first individual cooking cavity;

a second burner provided at the second individual cooking cavity;

a main air supplying passage to supply air to the second individual cooking cavity; and a subsidiary air supplying device configured to be controlled to supply air from an outside of the cooking cavity to the first individual cooking cavity according to whether the divider is detached or mounted in the cooking cavity and whether at least one of the first burner and the second burner is operated, the subsidiary air supplying device including an air supplying fan to forcedly move the air.

2. The gas oven of claim 1, wherein the first burner comprises an inlet hole disposed at an inside the subsidiary air supplying passage.

3. The gas oven of claim 1, wherein the subsidiary air supplying passage includes an overflow hole, whereby a remaining portion of the air that flows at the inside of the subsidiary air supplying passage escapes to an outside of the subsidiary air supplying passage to flow around the first burner.

4. The gas oven of claim 1, further comprising:

a main air discharge passage to discharge waste gas from the first individual cooking cavity; and a subsidiary air discharge device configured to selectively discharge waste air of the second individual cooking cavity.

5. The gas oven of claim 1, wherein the subsidiary air supplying device further comprises:

a subsidiary air supplying passage; and an air supplying damper to open/close the subsidiary air supplying passage.

6. The gas oven of claim 5, wherein when the divider is separated from the cooking cavity and one of the first burner and the second burner is operated, the subsidiary air supplying device shuts off the subsidiary air supplying passage.

7. The gas oven of claim 5, wherein when a self cleaning of the gas oven is performed, the subsidiary air supplying device shuts off the subsidiary air supplying passage.

8. A gas oven, comprising:

a body;

a cooking cavity formed inside the body;

a divider to divide the cooking cavity into a first individual cooking cavity and a second individual cooking cavity, the divider being detachable;

a first burner provided at the first individual cooking cavity;

a second burner provided at the second individual cooking cavity;

a main air discharge passage to discharge waste gas from the first individual cooking cavity; and a subsidiary air discharge device configured to be controlled to discharge waste air of the second individual cooking cavity according to whether the divider is detached or mounted in the cooking cavity and whether at least one of the first burner and the second burner is operated, wherein the subsidiary air discharge device comprises:

a subsidiary air discharge passage to communicate the second individual cooking cavity with an outside of the body; and an air discharge damper to open/close the subsidiary air discharge passage.

9. The gas oven of claim 8, wherein the subsidiary air discharge passage is separately provided from the main air discharge passage.

10. The gas oven of claim 8, wherein the subsidiary air discharge passage joins the main air discharge passage at one point of the main air discharge passage.

11. The gas oven of claim 8, wherein when the divider is separated from the cooking cavity, the subsidiary air discharge device shuts off the subsidiary air discharge passage.

12. The gas oven of claim 8, wherein when a self cleaning of the gas oven is being performed, the subsidiary air discharge device shuts off the subsidiary air discharge passage.

13. The gas oven of claim 8, further comprising:

a main air supplying passage to supply air to the second individual cooking cavity; and a subsidiary air supplying device to selectively supply air to the first individual cooking cavity.

* * * * *